US005475474A

United States Patent [19]

Osbourne et al.

[11] Patent Number: 5,475,474

[45] Date of Patent: Dec. 12, 1995

[54] SLIDABLY MOUNTED WIPER SYSTEM

[75] Inventors: William G. Osbourne; Gerald J. Cavaliere, Fairport; Julio A. Sanchez-Baños, all of Webster, N.Y.

[73] Assignee: Xerox Corporation, Stamford, Conn.

[21] Appl. No.: 297,073

[22] Filed: Aug. 29, 1994

[51] Int. Cl.[6] ..... G03G 15/04

[52] U.S. Cl. ..... 355/229; 355/296; 355/212; 15/1

[58] Field of Search ..... 355/296, 232, 355/229, 228, 212; 118/652; 15/1

[56] References Cited

U.S. PATENT DOCUMENTS 3,961,848 6/1976 Turner .
4,666,290 5/1987 Yoshiura .

*Primary Examiner*—R. L. Moses
*Attorney, Agent, or Firm*—Denis A. Robitaille

[57] ABSTRACT

A wiper system for use in an electrophotographic printing machine having a variety of electrophotographic subsytems situated about a photoconductive member. The electrophotographic printing machine includes a slidable module for supporting a photoconductive member, the slidable module being movable relative to the electrophotographic subsytems such that the photoconductive member is retractably displaceable from the electrophotographic printing machine to provide access thereto. A wiper assembly, engaging with an exposed surface of at least one of the electrophotographic subsytems, is mounted on the slidable module such that the wiper means is slidably engaged with the exposed surface to provide cleaning action thereagainst in accordance with the slidable movement of the slidable module.

11 Claims, 4 Drawing Sheets

SLIDABLY MOUNTED WIPER SYSTEM

The present invention relates generally to a wiper system for use in an electrophotographic printing machine, and, more specifically, concerns an apparatus for wiping the surface of an illumination lamp for removing contaminants therefrom, as, for example, an interdocument lamp used for illuminating selected areas of a charged photoconductive member in an electrophotographic printing machine.

In a typical electrophotographic copying or printing machine, a photoconductive member is initially charged to a substantially uniform potential. The charged portion of the photoconductive member is exposed to a light image of an original document being reproduced so as to selectively dissipate the charge on the photoconductive member in the irradiated areas. This process records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

In the electrophotographic process described hereinabove, certain areas of the photoconductive member which are initially charged to a substantially uniform potential may not be used for producing the latent image. These areas include edge margin regions adjacent the sides of the latent image recorded on the photoconductive member, as well as interdocument areas such as the non-image areas situated before the first electrostatic latent image, between adjacent latent images, and after the last latent image of a series of latent images recorded on the photoconductive member. If these non-image areas remain charged, the areas are subsequently developed with toner particles. Since these toner particles are not transferred to the copy sheet, they must be cleaned from the photoconductive member prior to the next successive imaging cycle or they will degrade the copy. Preventing development of these areas reduces toner consumption and failures in the cleaning system. As a result, it has become a common practice in the art to remove charge present in non-image areas on the photoconductive member, or "erase" these charged non-image areas so that they are discharged prior to development. Thus, the non-image areas on the photoconductive member will not be developed with toner particles and there is no requirement to clean the photoconductive member in these non-image areas.

Various prior art charge erase devices are known in the art for addressing the problem of erasing undesired charge from selected areas of a photoconductive member. Typically, an illumination device such as an erase lamp is used to remove charge present in non-image areas. For example, an erase lamp extending across the width of the photoconductive member perpendicular to the path of movement may be energized for a selected time period as a function of the velocity of the photoconductive member so as to illuminate the entire interdocument area in order to erase the charged area between a series of latent images on the photoconductive member. The selected time of energization varies as a function of the size of the interdocument area. These so called interdocument erase lamps have also been utilized for generating "test patches" having a predetermined voltage level on the photoconductive member in the interdocument region, wherein the voltage level of such test patches can be measured and used to adjust certain variable parameters for maintaining optimum-machine operation.

An extensive listing of references which disclose charge erase devices used in electrophotographic applications is provided in U.S. Pat. No. 4,806,975, the contents of which are hereby incorporated by reference. That patent discloses a multifunction plasma-erase lamp which incorporates a segmented electrode, each segment being selectively energized and associated with a specific erase function (interdocument, edge erase, formation of a test patch area, etc.). In addition, U.S. Pat. No. 4,767,172, the contents of which are also incorporated by reference herein, discloses the use of LED arrays used in electrophotographic machines for test patch generation as well as for interdocument and edge erasure of the photoconductive surface. In particular, that patent makes reference to U.S. Pat. No. 4,255,042, also incorporated by reference herein, wherein a segmented light pipe is disclosed for accurate erasure of charge on a photoconductive member. More recently, multi-function erase lamps have been developed and disclosed, as for example, in U.S. Pat. No. 5,300,985, the contents of which are hereby incorporated by reference, wherein the conventional erase functions of interdocument erase and fixed edge erase, as described above, as well as other functional features such as edge shift and the production of so called "test patches", are performed via a single illumination device.

It will be appreciated that ever demanding customer requirements for improved copy quality and extended product life have made it necessary to provide lamps with significantly improved light output stability, optimized spectral output and improved life characteristics. However, one significant issue relating to copy quality, as further related to interdocument lamp output stability and product life, is the problem, associated most directly with the triboelectrification process, caused by the inadvertent escape of developing material, and, in particular, liquid or dry toner particles, from the developer housing. Airborne toner particles are readily attracted to the interdocument lamp, as well as various other processing stations and machine component surfaces within the electrostatographic apparatus. In addition, paper debris and other airborne contaminants are often generated by the movement of paper or other copy substrates through the machine. Contamination of the interdocument lamp surface adversely affects machine reliability and performance as well as copy quality by yielding non-uniform exposure, increased background, and generally unacceptable copy quality, often causing unscheduled maintenance and repair by skilled field service technicians. A secondary problem, associated directly with the contamination of segmented interdocument lamps, as disclosed in previously referenced U.S. Pat. No. 4,255,042, exists in the fact that service technician cleaning of the interdocument lamp actually exacerbates the contamination problem by pushing toner particles and other debris into the narrow gaps between each segment, thereby causing permanent copy quality defects and leading to premature replacement of the interdocument lamp.

In accordance with the present invention, there is provided a wiper system for cleaning a surface situated within a machine frame, comprising wiper means for engaging with the surface to be cleaned, a slidable module mounted within the machine frame so as to be slidably movable relative to the machine frame, and means for mounting the wiper means on the slidable module such that the wiper means is slidably engaged with the surface to be cleaned.

Pursuant to another aspect of the present invention, there is also provided a wiper system for use in an electrophotographic printing machine including a plurality of electrophotographic subsytems situated about a photoconductive member is provided. The wiper system includes a slidable module for supporting the photoconductive member, wherein the slidable module is movable relative to the plurality of electrophotographic subsytems such that the photoconductive member is retractably displaceable from the electrophotographic printing machine to provide access thereto, wiper means for engaging with an exposed surface at least one of the plurality of electrophotographic subsystems, and means for mounting the wiper means on the slidable module such the wiper means is slidably engaged with the exposed surface to provide cleaning action thereagainst in accordance with the sliding movement of the slidable module.

In accordance with yet another aspect of the present invention, there is provided an electrophotographic printing machine of a type in which a light source is employed to discharge selected portions of a charged photoconductive member adapted to have successive electrostatic latent images of original documents recorded thereon. The electrophotographic printing machine of the present invention comprises a slidable photoreceptor module for supporting the photoconductive member, the slidable module being movable relative to the light source such that the photoconductive member is slidably displaceable with respect to the light source, wiper means for engaging with a light emitting surface of the light source, and means for mounting the wiper means on the slidable photoreceptor module such that the wiper means is slidably engaged with the light emitting surface of the light source to provide cleaning action thereagainst in accordance with sliding movement of the slidable photoreceptor module.

While the present invention will hereinafter be described in connection with a preferred embodiment and method of use, it will be understood that it is not intended to limit the invention to that embodiment or method of use. On the contrary, the following description is intended to cover all alternatives, modifications, and equivalents, as may be included within the spirit and scope of the invention as defined by the appended claims. Other aspects of the present invention will become apparent as the following description proceeds and upon reference to the drawings, in which:

Figure 1:
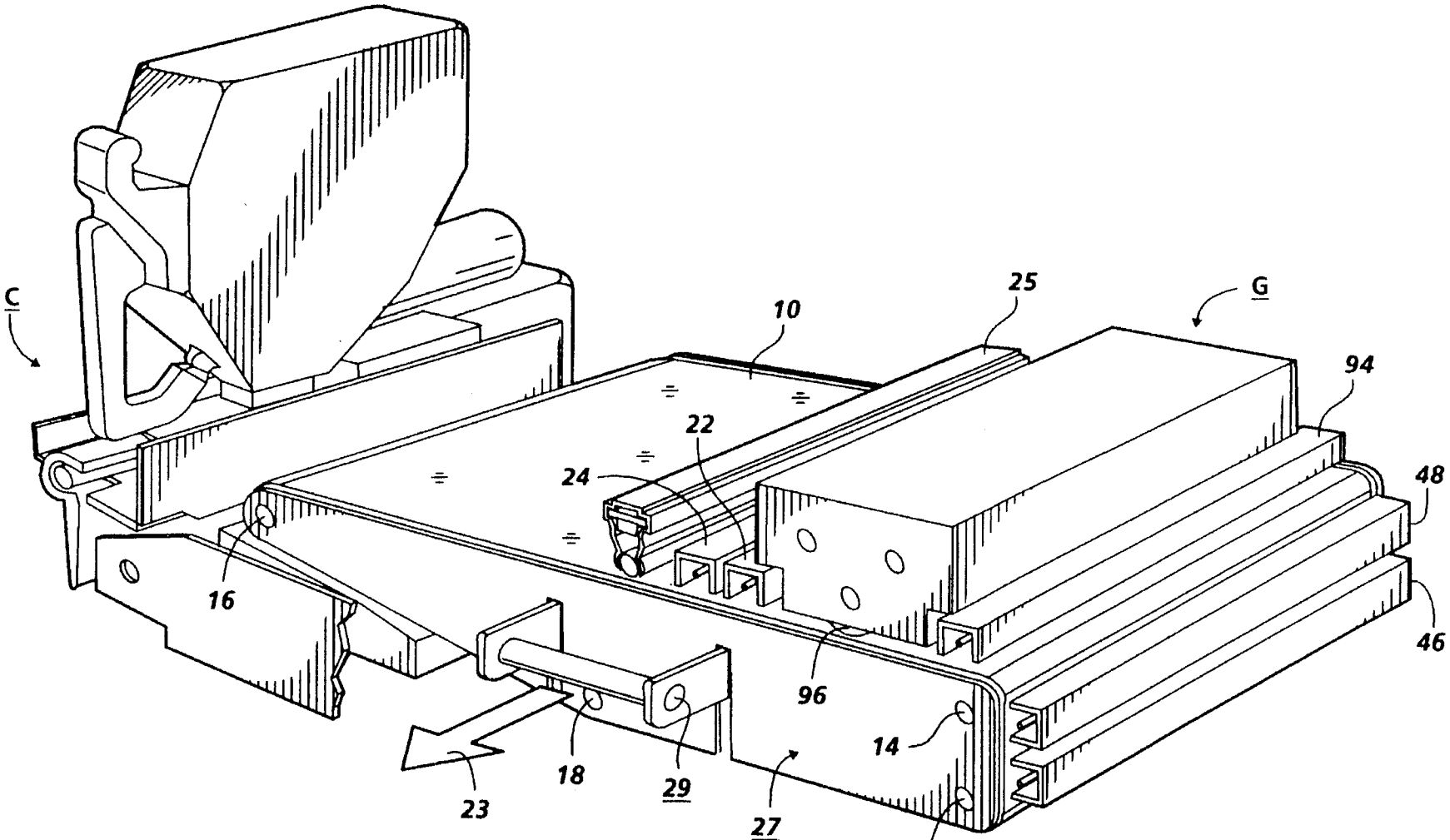
FIG. 1 is a perspective view showing a releasably mounted photoconductor belt module and the various subsytems of a typical electrophotographic printing machine situated about the photoconductive belt.
Figure 3:
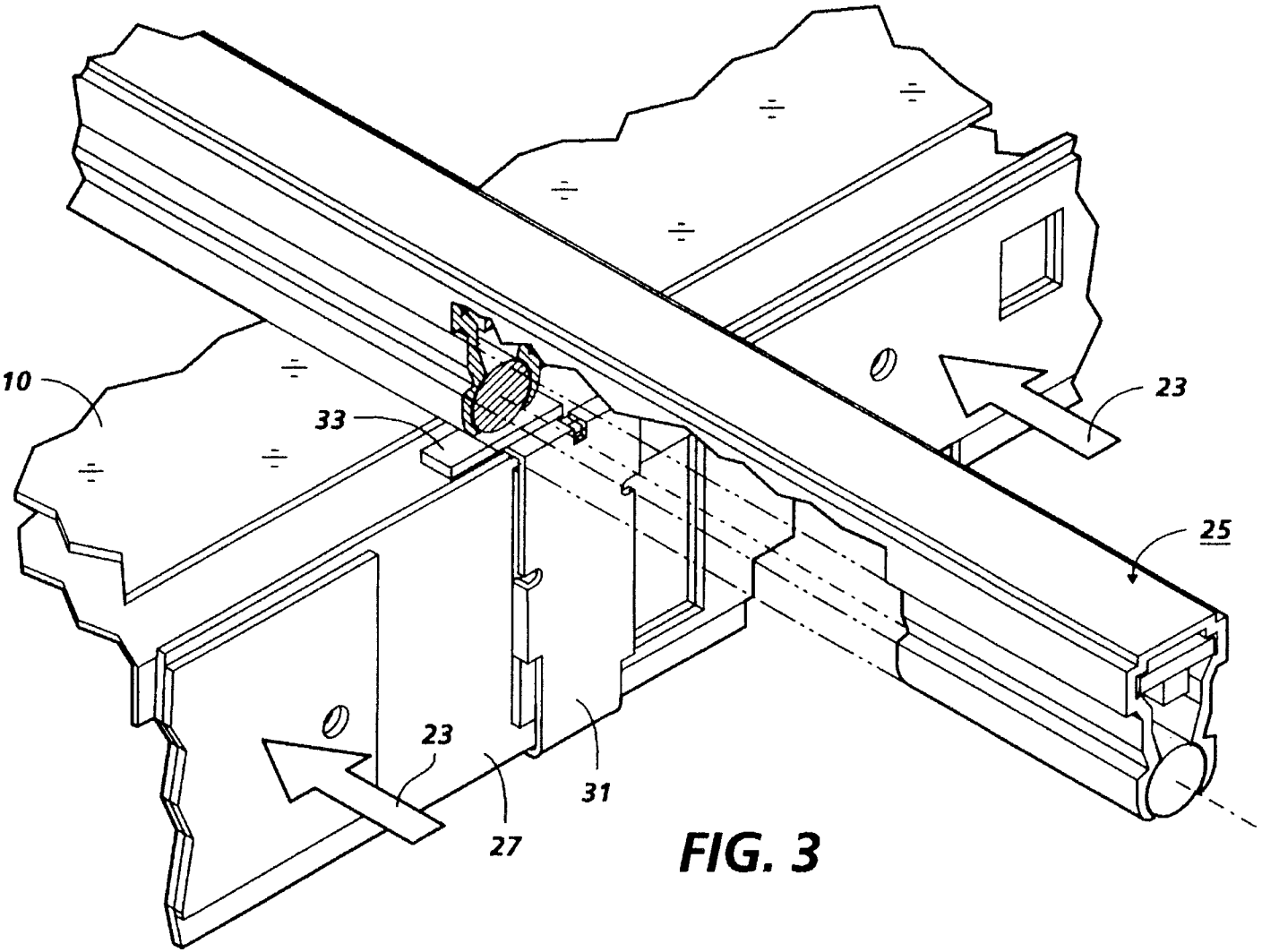
Figure 4:
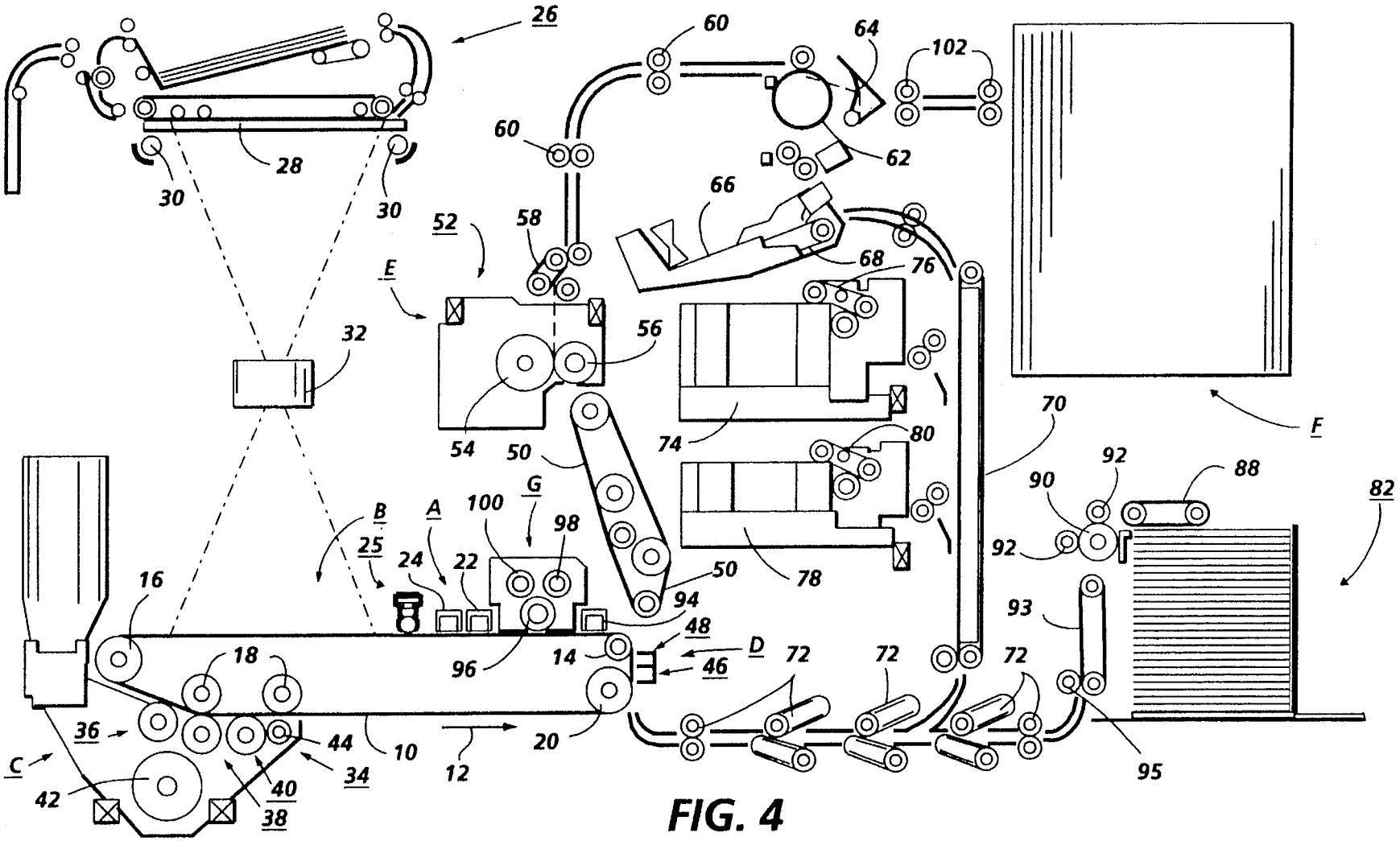

FIG. 3 is an enlarged perspective view of the photoconductor belt module of FIG. 1 as seen from the inboard side of a machine, showing the photoconductor belt module displaced from its operative position to illustrate the operation of the self actuated lamp wiper system of the present invention; and FIG. 4 is a schematic elevational view depicting an illustrative electrophotographic printing machine.

For a general understanding of the features of the present invention, reference is made to the drawings, wherein like reference numerals have been used throughout to identify identical or similar elements. Turning initially to FIG. 4, prior to discussing the invention in detail, a schematic depiction of an exemplary electrophotographic reproducing machine incorporating various machine components is furnished in order to provide a general background and understanding of the features of the present invention. Although the apparatus of the present invention is particularly well adapted for use in conjunction with a so called interdocument lamp incorporated into an automatic electrophotographic reproducing machine as shown in FIG. 4, it will become apparent from the following discussion that the lamp wiping system of the present invention is equally well suited for use in conjunction with various subsystems in a wide variety of electrostatographic processing machines as well as many other known devices and apparatus in which a surface is subject to contamination which can be removed by wiping. It will be further understood that the present invention is not necessarily limited in its application to the particular embodiment or embodiments shown and described herein.

The exemplary electrophotographic printing machine of FIG. 4 employs a photoconductive belt 10, preferably comprising a photoconductive material coated on a ground layer, which, in turn, is coated on an anti-curl substrate. Belt 10 is entrained about stripping roller 14, tensioning roller 16, rollers 18, and drive roller 20. Stripping roller 14 and rollers 18 are mounted rotatably so as to rotate with belt 10, while tensioning roller 16 is resiliently urged against belt 10 to maintain belt 10 under a desired tension and drive roller 20 is rotated by a motor (not shown) coupled thereto by any suitable means such as a drive belt. Thus, as roller 20 rotates, it advances belt 10 in the direction of arrow 12 to advance successive portions of the photoconductive surface of photoconductive belt 10 sequentially through the various processing stations disposed about the path of movement thereof. It will be understood that, although the present description is directed toward an exemplary electrophotographic printing machine having a photoconductive belt, a photoconductive drum system, as is well-known in the art, may also be utilized in the practice of the present invention.

Initially, a portion of photoconductive belt 10 passes through charging station A, whereat two corona generating devices, indicated generally by the reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt while filling in any areas missed by corona generating device 22.

After photoconductive belt 10 is charged, a light source, or so called interdocument lamp 25, is selectively energized to discharge the charge on the photoconductive belt 10 in selected non-image regions. Interdocument lamp 25 is situated such that its longitudinal axis extends in a direction substantially perpendicular to the direction of movement of belt 10 as indicated by arrow 12. In this way, lamp 25 extends across the width of belt 10 in order to provide the capability to erase unwanted charge between a trailing edge of one image frame and a leading edge of a subsequent image frame. Lamp 25 may also be segmented, as shown, for example, in previously referenced U.S. Pat. Nos. 4,255,042; 4,806,975 and 5,300,985, among other references. Segmenting of the interdocument lamp provides the capability to selectively erase charged areas of the photoconductive member, such as, for example, edge trim areas between the side edges of an image frame and the respective sides of the photoconductive belt 10. In a specific example, a segment adjacent one end of lamp 25 can be individually controlled to discharge the region defined by the outboard edge of the photoconductive belt and the registration edge of the latent image recorded thereon. A second segment may be provided for discharging a predetermined portion of the image frame to eliminate any registration line on the copy. Yet another segment may be provided for discharging the region of the image frame in which the holes of a computer form feed document are recorded. In addition, another segment may be dedicated to enable generation of a charged test patch in the interdocument area. In this scheme, individually controlled segments can be electrically connected to one another so that the segments can be energized in unison, whereby energization of multiple segments can be utilized to erase the charge across the entire width of the interdocument area.

Next, the charged portion of photoconductive belt 10 is advanced through imaging station B. At imaging station B, a document handling unit, indicated generally by reference numeral 26, is positioned over platen 28 of the printing machine. The document handling unit 26 sequentially feeds documents from a stack of documents placed in a document stacking and holding tray such that the original documents to be copied can be loaded face up into the document tray on top of the document handling unit. Using this system, a document feeder, located below the tray, feeds the bottom document in the stack to rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28. Imaging of the document is achieved by two flash lamps 30 mounted in the optics cavity for illuminating the document on platen 28. Light rays reflected from the document are transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document. Thereafter, photoconductive belt 10 advances the electrostatic latent image recorded thereon to development station C.

At development station C, a magnetic brush developer housing, indicated generally by reference numeral 34, is provided, having three developer rolls, indicated generally by the reference numerals 36, 38 and 40. A paddle wheel 42 picks up developer material in the developer housing and delivers it to the developer rolls. When the developer material reaches rolls 36 and 38, it is magnetically split between the rolls with approximately half of the developer material being delivered to each roll. Photoconductive belt 10 is partially wrapped about rolls 36 and 38 to form an extended development zone. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet (not shown) is moved into contact with the toner powder image on belt 10. The developed image on belt 10 contacts the advancing sheet of support material in a timed sequence and is transferred thereon at transfer station D. As can be seen in the illustrated embodiment, a corona generating device 46 charges the copy sheet to a proper potential so that the sheet is electrostatically secured or "tacked" to belt 10 and the toner image thereon is attracted to the copy sheet.

Copy sheets may also be fed to transfer station D from a secondary tray 74 which includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by a sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from an auxiliary tray 78. As in the case of the secondary tray 74, the auxiliary tray 78 includes an elevator driven by a bidirectional AC motor and a controller having the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are supplemental sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

After transfer, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller 56 abuts the fuser roller 54 to provide the necessary pressure to fix the toner powder image to the copy sheet. In this fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl, as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together. Alternatively, duplex solenoid gate 64 diverts the sheet into duplex tray 66, providing intermediate storage for those sheets that have been printed on one side and on which an image will be subsequently printed on the second, opposed side thereof, i.e. the sheets being duplexed. The sheets are stacked in duplex tray 66 face down on top of one another in the order in which they are copied. In order to complete duplex copying, the simplex sheets in tray 66 are fed, in seriatim, by a bottom feeder 68 from tray 66 back to transfer station D, via conveyor 70 and rollers 72, for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Invariably, after the copy sheet is separated from photoconductive belt 10, some residual particles remain bonded thereto. After transfer, photoconductive belt 10 passes beneath yet another corona generating device 94 which charges the residual toner particles to the proper polarity for breaking the bond between the toner particles and the belt. Thereafter, a pre-charge erase lamp (not shown), located inside the loop formed by photoconductive belt 10, discharges the photoconductive belt 10 in preparation for the next charging cycle. Residual particles are removed from the photoconductive surface at cleaning station G. Cleaning station G may includes an electrically biased cleaner brush 96 and two waste and reclaim de-toning rolls 98 and 100. The reclaim roll 98 is electrically biased negatively relative to the cleaner roll 96 so as to remove toner particles therefrom while the waste roll 100 is electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by a controller (not shown) which is preferably a programmable microprocessor which manages all of the machine functions hereinbefore described. Among other things, the controller provides a comparison count of the copy sheets, the number of documents being recirculated, the number of copy sheets selected by the operator, time delays, jam indications and interdocument lamp timing information. The operation of all of the exemplary systems described hereinabove may be accomplished by conventional user interface control switch inputs from the printing machine consoles selected by the operator. Conventional sheet path sensors or switches may be utilized to keep track of the position of documents and the sheets in the machine. In addition, the controller regulates the various positions of gates and switching depending upon the mode of operation selected.

The foregoing description should be sufficient for the purposes of the present application for patent to illustrate the general operation of an electrophotographic reproducing apparatus. As previously discussed, the electrophotographic reproducing apparatus may take the form of any of several well known systems or machines such that variations of specific electrostatographic processing subsystems or processes may be expected without affecting the operation of the present invention.

It will be understood that the life of an electrophotographic copying machine is limited by the electrical life of the photoconductive member, as well as other limited life components. As such, it is a common practice to provide such electrophotographic copying machines with a replaceable photoconductive member. However, replacement of the photoconductive member can often be a complex and intricate operation which can not only be time-consuming and expensive, but can also require a great deal of skill and care by a trained service representative in order to avoid damage to the photoconductive member as well as the other components of the machine. Various types of replaceable photoconductive members, both in the form of a drum member as well as a belt member, are known in the art. Of particular interest, for illustrative purposes, are U.S. Pat. Nos. 4,319,829 and 4,416,532, hereby incorporated by reference, which teach a photoconductive belt removal system, including a cantilever mounted photoconductor belt supporting capstan which is rigidly attached to a pivotable handle for releasing the photoconductive belt module from the machine frame to allow access to the photoconductive member.

Moving now to FIG. 1, a perspective view of a releasably mounted photoconductive belt module 27 and the various subsytems of an electrophotographic printing machine mounted about the photoconductor belt 10 is shown. Although not specifically shown in FIG. 1, a machine frame is configured for appropriate attachment and interfacing between the photoconductive belt 10 and other electrophotographic processing elements such as corona generating devices 22 and 24, interdocument lamp 25, the magnetic brush developer housing 34, and corona generating devices 46 and 48, as previously described with respect to FIG. 4. The photoconductive belt 10 is supported on a slidable belt module 27 which is releasably secured relative to the machine frame by a latching assembly (not shown), permitting relatively easy replacement of the photoconductive belt member 10, entrained about roller members 14, 16, 18, and 20. As can be seen from FIG. 1, the photoconductive belt module 27 includes a pivotable handle 29 situated adjacent an outboard surface of the photoconductive belt 10 for facilitating slidable movement of the belt module 27 so that the module 27 is retractably displaceable from the machine frame. The pivotable handle 29 may be arranged to operate a tension applying releasing shoe against the inner surface of the photoconductive belt 10, as disclosed in the art referenced herein, for providing the additional function of releasing tension against belt 10 so that a closed loop belt may be removed from or installed over the plurality of rollers 14, 16, 18, and 20. Various releasable belt module concepts are known in the xerographic and electrophotographic arts, wherein such devices are directed toward providing means for simplifying the inspection, servicing, installation, replacement or removal of drums or belts by effecting retractable displacement of a module from a machine frame. As will be seen from the following description, the present invention makes advantageous use of a removable belt module by providing a wiping apparatus which is operative in a self actuating manner with the movement of the belt module to wipe the surface of an adjacent subassembly when the belt module is slidably removed or inserted into the machine frame.

Figure 2:
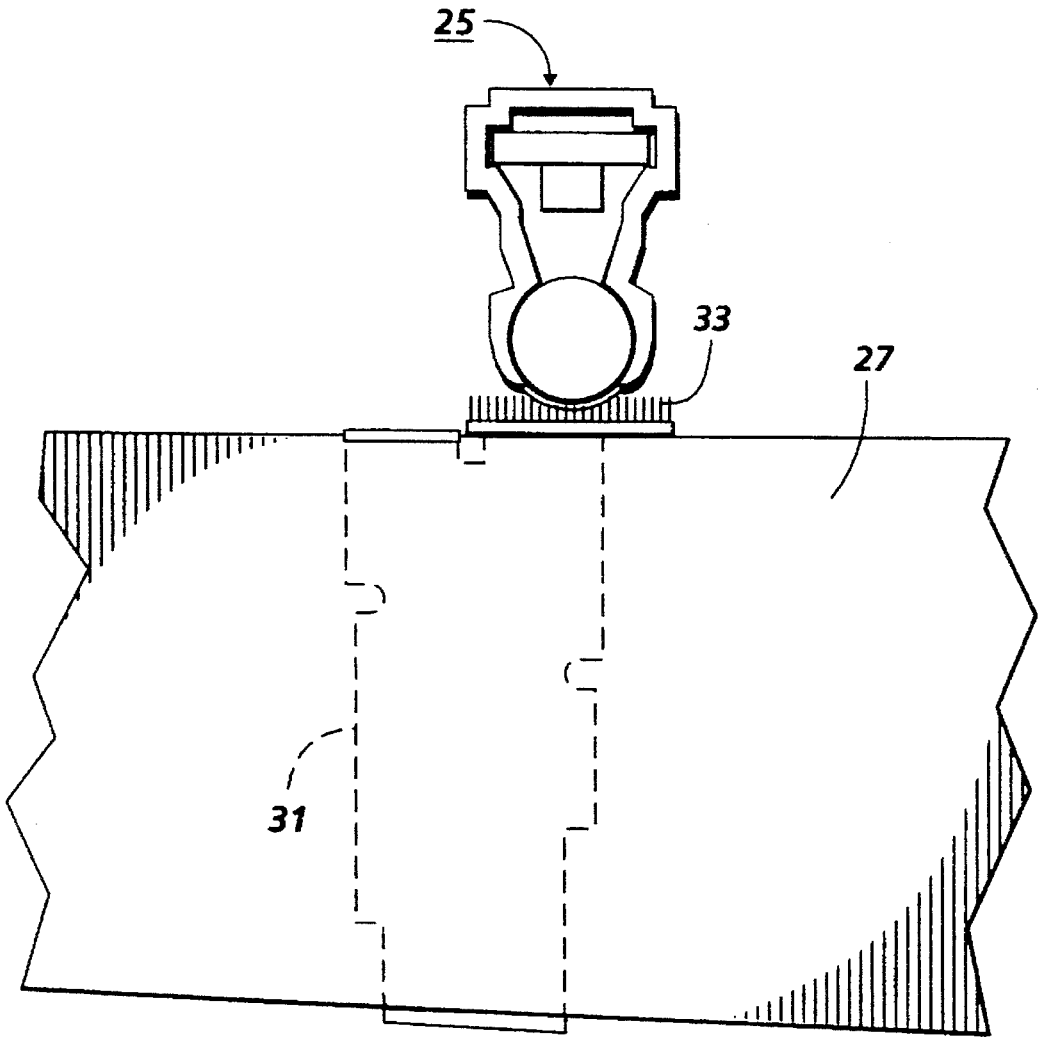
FIG. 2 is a schematic elevational view showing the lamp wiper system of the present invention positioned adjacent an exemplary interdocument lamp.

Moving now to FIG. 2, a schematic elevational view showing the lamp wiper system of the present invention is provided, wherein a wiper element 33 is positioned adjacent an exemplary interdocument lamp 25 as, for example, disclosed in commonly assigned U.S. patent application identified as Attorney's Docket No. D/94345, filed on even date herewith, the contents of which being incorporated by reference herein. The self actuated lamp wiper system of the present invention includes a mounting bracket 31 and a wiper element 33. Mounting bracket 31 is fixably mounted along the inboard side of slidable belt module 27 so as to be slidably movable therewith. Wiper element 33 is also fixably mounted to mounting bracket 31 so as to also be slidably movable therewith. The wiper element 33 is situated adjacent the surface to be cleaned, in this case, the surface of interdocument lamp 25, as shown. Thus, the wiper element 33 is mounted on a mounting bracket 31 which is further mounted on belt module 27, wherein the module 27 is slidable in a plane substantially parallel to the surface of the interdocument lamp 25. In a preferred embodiment, the mounting bracket 31 is configured so as to resiliently urge the wiper element 33 against the surface of interdocument lamp 25. Thus, the wiper element 33, being interposed between the photoconductive belt 10 and the interdocument lamp 25, is pressed into engagement with the surface of the interdocument lamp 25 in such a manner that the wiper element will be moved with the movement of the photoconductive belt module 27, whereby the wiper element 33 "sweeps" the surface of ,the interdocument lamp 25 for cleaning the surface thereof. It will be understood that the wiper element 33 of the present invention may be advantageously positioned adjacent various other lamp elements or other subsystems, such as, for example, a corotron wire, for effectively cleaning the surface thereof.

By way of example, the wiper element 33 includes a multiplicity of fibers extending outwardly therefrom for contacting the surface to be cleaned. In a preferred embodiment, the fibers making up the wiping element 33 may be fabricated from a polyamide material such as nylon provided on a polyester or synthetic latex backing strip so as to create a carpet-like layer of material. The fibers may be provided as a yarn type material, in non-textured, continuous, multifilament form. The pad fabric thickness is on the order of 3 mils, having a filling count of approximately 20 per square centimeter, as manufactured, for example, by the Collins and Aikman Corporation of Roxboro, N.C. It will be understood that various other known products may also be suitable depending upon various operating environments. Wiper element 33 may be advantageously provided in the form of a pad having an adhesive backing so as to permit replacement of the pad on mounting bracket 31.

Turning now to FIG. 3, the operation of the lamp wiper of the present invention will be described with reference to a perspective view of the photoconductor belt module as shown from the inboard side of a machine, wherein the photoconductor belt module 27 is shown, partially displaced from its operative position to illustrate the operation of the lamp wiper system. As shown in FIG. 3, an exemplary interdocument lamp 25 includes a light propagating lens or so called light pipe and an optically transmissive protective cover, as disclosed in previously referenced Attorney's Docket No. D/94345 is shown. In accordance with the present invention, the belt module 27 is adapted for easy withdrawal from the machine so as to provide access to the photoreceptor belt 10. The photoreceptor module 27 is slidably mounted within the machine frame (not shown) such that the photoreceptor belt module 27 can be displaced in the direction of arrows 23. Thus, in order to replace the photoreceptive belt 10, it is merely necessary to slide the belt module 27 in the direction of arrows 23, although, depending upon machine configuration, it may also be necessary to first remove other machine components. By sliding the module 27 in the direction of arrows 23, as illustrated in FIG. 3, the mounting bracket 31 and attached wiper element 33 are also displaced in the direction of arrows 23. Displacement of the photoreceptor belt module 27 causes the mounting bracket 31 and wiper element 33 to be set in motion, thereby wiping the interdocument lamp surface, providing cleansing action against the interdocument lamp surface.

In review, the slidably mounted wiper system of the present invention includes a wiper element fixedly mounted to slidable photoreceptor module via a mounting bracket. The wiper element is further positioned in engagement with a surface to be cleaned such that the surface is wiped in a self actuated manner by routine withdrawal of the photoreceptor belt module. Cleaning of the surface maintains peak performance of the device being cleaned which, in turn, optimizes output copy quality in the electrophotographic machine.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. A wiper system for use in an electrophotographic printing machine including a plurality of electrophotographic subsytems situated about a photoconductive member, comprising a slidable module for supporting said photoconductive member, said slidable module being movable relative to the plurality of electrophotographic subsytems such that said photoconductive member is retractably displaceable from the electrophotographic printing machine to provide access thereto;

wiper means for engaging with an exposed surface at least one of said plurality of electrophotographic subsytems; and means for mounting said wiper means on said slidable module such that said wiper means is slidably engaged with the exposed surface to provide cleaning action thereagainst in accordance with the slidable movement of said slidable module.

2. The wiper system of claim 1, wherein said wiper means includes a multiplicity of extended fibers for contacting the surface to be cleaned.

3. The wiper system of claim 1, wherein said wiper means includes adhesive means for adhesively affixing said wiper means to said mounting means.

4. The wiper system of claim 1, wherein said mounting means includes means for resiliently urging said wiper means into engagement with the surface to be cleaned.

5. The wiper system of claim 1, wherein said slidable module is slidable in a plane substantially parallel to the surface to be cleaned.

6. The wiper system of claim 1, wherein at least one of said plurality of electrophotographic subsytems includes a light source having a cleanable, light emitting surface.

7. An electrophotographic printing machine of a type in which a light source is employed to discharge selected portions of a charged photoconductive member adapted to have successive electrostatic latent images of original documents recorded thereon, comprising:

a slidable photoreceptor module for supporting said photoconductive member, said slidable module being movable relative to the light source such that said photoconductive member is slidably displaceable with respect to the light source;

wiper means for engaging with a light emitting surface of the light source; and means for mounting said wiper means on said slidable photoreceptor module such that said wiper means is slidably engaged with the light emitting surface of the light source to provide cleaning action thereagainst in accordance with sliding movement of said slidable photoreceptor module.

8. The electrophotographic printing machine of claim 7, wherein said wiper means includes a multiplicity of extended fibers for contacting the surface to be cleaned.

9. The electrophotographic printing machine of claim 7, wherein said wiper means includes adhesive means for adhesively affixing said wiper means to said mounting means.

10. The electrophotographic printing machine of claim 7, wherein said mounting means includes means for resiliently urging said wiper means into engagement with the surface to be cleaned.

11. The electrophotographic printing machine of claim 7, wherein said slidable module is slidable in a plane substantially parallel to the surface to be cleaned.

* * * * *